United States Patent [19]

Solia

[11] Patent Number: 4,832,570

[45] Date of Patent: May 23, 1989

[54] BOAT PROPELLER HAVING COUNTER-ROTATING SCREWS AND PROVIDED WITH A NOZZLE

[75] Inventor: Franco Solia, Milan, Italy

[73] Assignee: Akzo S.r.l., Milan, Italy

[21] Appl. No.: 214,061

[22] Filed: Jul. 1, 1988

[30] Foreign Application Priority Data

Jul. 1, 1987 [IT] Italy ..... 53490/87[U]

[51] Int. Cl.[4] ..... B63H 5/10

[52] U.S. Cl. ..... 416/93 A; 416/129; 416/189; 415/68; 440/67

[58] Field of Search ..... 416/129 A, 189 B, 93 A, 416/93 M; 440/67, 80, 81, 66, 89; 415/63, 68, 66, 67, 212 A

[56] References Cited

U.S. PATENT DOCUMENTS

| | | | |
|---|---|---|---|
| 2,672,115 | 3/1954 | Conover | 440/80 X |
| 3,109,495 | 11/1963 | Lang | 416/129 A X |
| 3,112,610 | 12/1963 | Jerger | 440/67 X |
| 3,499,412 | 3/1970 | Anthes et al. | 440/67 |
| 4,304,558 | 12/1981 | Holterman | 440/67 |
| 4,324,985 | 4/1982 | Oman | 440/8 X |
| 4,422,820 | 12/1983 | Kirsch et al. | 415/2 A X |
| 4,619,584 | 10/1986 | Brandt | 416/129 A |
| 4,637,801 | 1/1987 | Schultz | 416/189 B X |

FOREIGN PATENT DOCUMENTS

| | | | |
|---|---|---|---|
| 748218 | 10/1944 | Fed. Rep. of Germany | 440/67 |
| 883255 | 7/1953 | Fed. Rep. of Germany | 440/67 |
| 941048 | 3/1956 | Fed. Rep. of Germany | 440/67 |
| 629382 | 12/1961 | Italy | 440/67 |
| 63947 | 8/1949 | Netherlands | 440/67 |
| 2190344 | 11/1987 | United Kingdom | 440/67 |

*Primary Examiner*—Everette A. Powell, Jr.
*Attorney, Agent, or Firm*—Sughrue, Mion, Zinn, Macpeak & Seas

[57] ABSTRACT

A screw propeller (10) for boats includes two counter-rotating screws (12, 16) coaxial with an annular nozzle (20). The aft screw (16) has a smaller diameter than the forward screw (12) and the nozzle (20) has an annular duct (B) situated upstream of the rear screw (16) and arranged to discharge the exhaust gases from the engine.

6 Claims, 2 Drawing Sheets

BOAT PROPELLER HAVING COUNTER-ROTATING SCREWS AND PROVIDED WITH A NOZZLE

DESCRIPTION

The present invention relates to a screw propeller for boats, of the type including two counter-rotating screws coaxial with an annular nozzle.

The object of the present invention is to provide a propeller of the above type which, as well as being very efficient, enables the boat to reach high speeds.

According to the invention, this object is achieved by virtue of the fact that the aft screw has a smaller diameter than the forward screw and by virtue of the fact that the nozzle has at its rear an annular duct situated substantially upstream of the aft screw and arranged for the discharge of pressurized gases.

By virtue of these characteristics, the aft screw behaves substantially like a supercavitating surface screw and the annular flow of gas which emerges from the rear of the annular duct of the nozzle enables the lateral friction due to the wash from the aft screw to be eliminated.

The pressurized gases supplied to the nozzle are preferably the exhaust gases from the engine of the boat.

Further characteristics and advantages of the propeller according to the invention will become clear from the detailed description which follows with reference to the appended drawings, provided by way of non-limiting example, in which.

Figure 1:
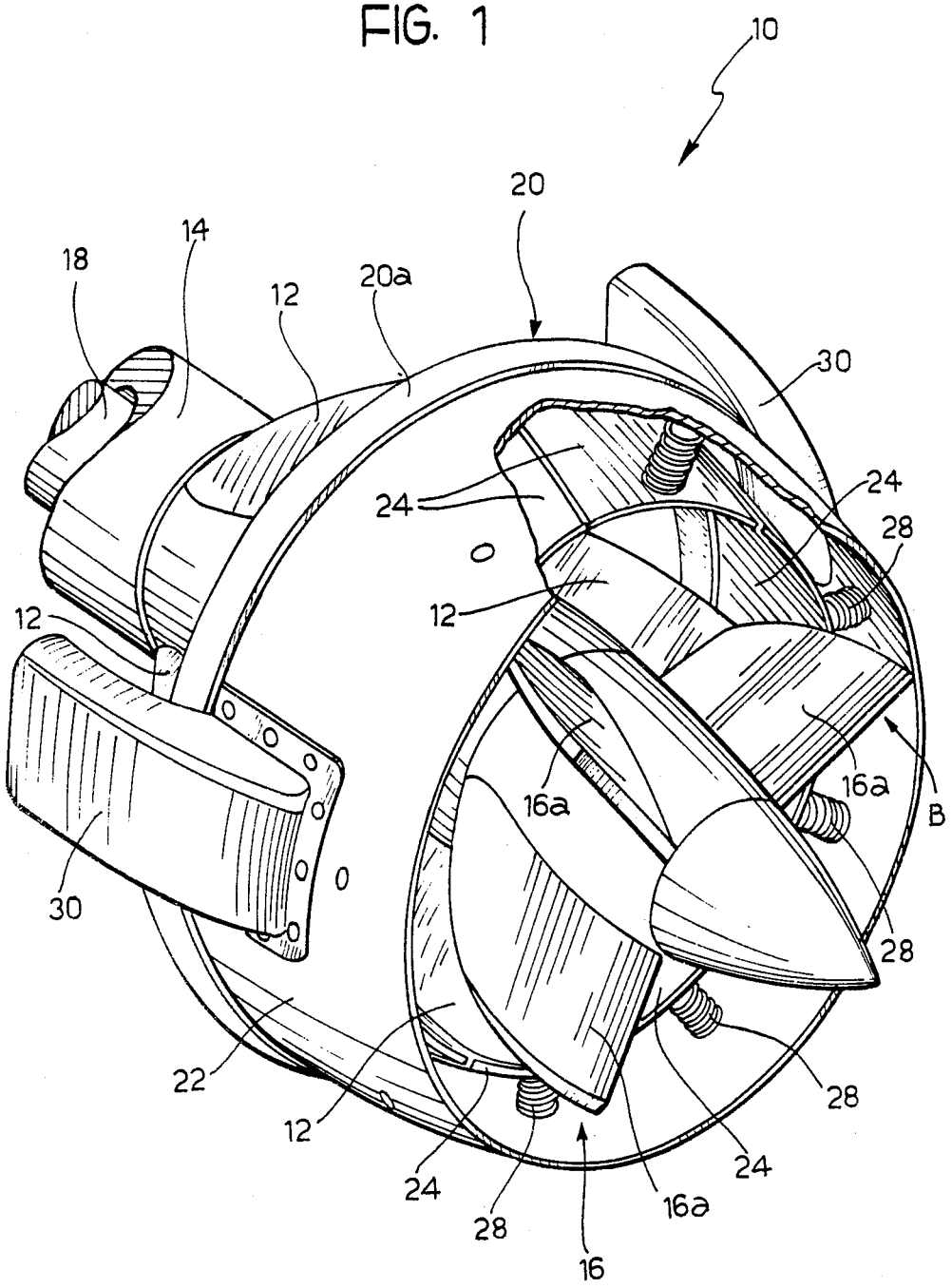
FIG. 1 is a perspective view of a propeller according to the invention.
Figure 2:
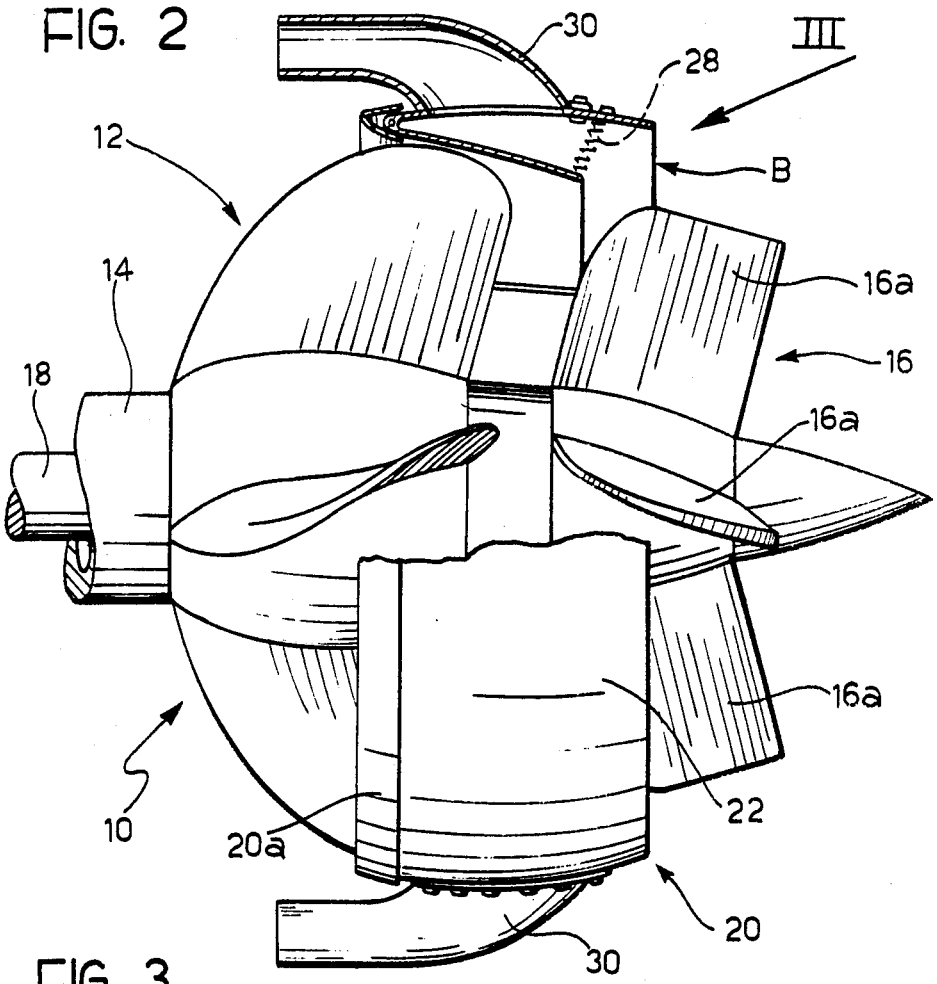
FIG. 2 is a partially-sectioned side view of the propeller of FIG. 1.

With reference to the drawings, a screw propeller is generally indicated 10 and includes a forward screw 12 rotated by a hollow shaft 14 and an aft counter-rotating screw 16 rotated by a shaft 18 coaxial with the hollow shaft 14.

The forward screw 12 and the aft screw 16 are partially ducted in a hollow annular nozzle 20 constituted by an outer side wall 22 and an inner side wall 24, of frusto-conical shape, defining an annular cavity A. The inner annular wall 24 is constituted by a plurality of sectors articulated at 26 to the outer annular wall 22 and a helical compression spring 28 is interposed between each sector of the wall 24 and the outer annular wall 22.

As is clearly shown in the drawings, the annular walls 22 and 24 diverge so as to define at the rear an annular duct B situated substantially in correspondence with the peripheral zone of the blades 16a of the aft screw 16. The outer annular wall 22 extends beyond the inner annular wall 24 so as partially to surround the aft screw 16.

The nozzle 20 is provided with a forward attachment edge 20*a* for protecting the zone of articulation 26 of the sectors 24 to the outer annular wall 22.

The outer annular wall 22 of the nozzle 20 has two connectors 30 for connection to the exhaust manifold of the engine of the boat (not illustrated).

In operation, an annular flow of exhaust gases emerges from the annular duct B and flows over the ends of the blades 16a of the aft screw 16. The pitch of the aft screw 16 is selected so that it can further accelerate the flow of liquid directed by the forward screw 12. The rate of rotation of the forward screw 12 may be equal to or different from the rate of rotation of the aft screw 16 and, in addition, their two shafts may take up equal or different powers in dependence on the type of screw and the pitch used.

Figure 3:
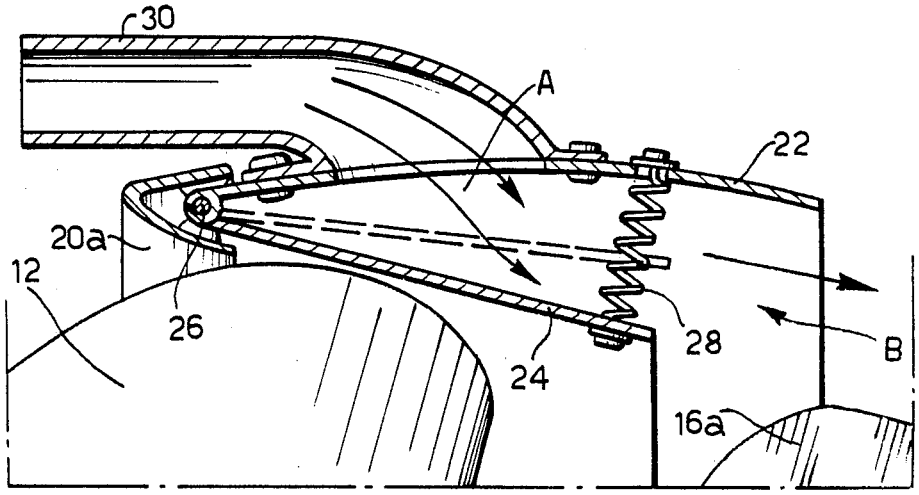
FIG. 3 is a detail of FIG. 2 on an enlarged scale.

As the speed of the boat increases, the discharge section of the nozzle B is reduced by virtue of the pivoting of the sectors of the inner annular wall 24 in correspondence with the articulations 26, the pivoting being opposed by the helical springs 28. In fact, a pressure acts on the conical inner wall 24 which tends to make the sectors 24 assume the configuration illustrated in broken outline in FIG. 3. This reduction in the discharge area of the duct B enables the resistance of the propeller itself to forward progress to be reduced considerably, without reducing the effectiveness of the annular flow of gases in terms of the efficiency of the propeller.

I claim:

1. A screw propeller for boats, of the type comprising two counter-rotating screws coaxial with an annular nozzle, characterised in that the aft screw (16) has a smaller diameter than the forward screw (12), and in that the nozzle (20) has at its rear an annular duct (B) situated substantially upstream of the aft screw (16) and arranged for the discharge of pressurised gases.

2. A propeller according to claim 1, characterised in that the nozzle (20) is hollow and includes an outer annular wall (22) and an inner annular wall (24) which are connected to each other at the front in correspondence with the front edge (26, 20a) of the nozzle (20) and diverge so as to define the annular duct (B) at the rear.

3. A propeller according to claim 2, characterised in that the outer annular wall (22) of the nozzle (20) extends aft beyond the inner annular wall (24).

4. A propeller according to claim 2, characterised in that the inner annular wall (24) of the nozzle (20) is frusto-conical in shape and is divided into a plurality of sectors, each articulated at the front to the outer annular wall (22) so as to vary the discharge area of the annular duct (B), means (28) for the adjustment of the discharge area of the annular duct (B) being interposed between the sectors (24) and the outer annular wall (22).

5. A propeller according to claim 4, characterised in that the adjustment means comprise helical springs (28) for opposing the reduction of the discharge area when the speed in the liquid medium increases.

6. A propeller according to claim 1, characterised in that the nozzle (20) has external connectors (30) for connection to the exhaust system of the engine.

* * * * *